US009261805B1

(12) United States Patent
Aoki et al.

(10) Patent No.: US 9,261,805 B1
(45) Date of Patent: Feb. 16, 2016

(54) TONER SET FOR PRINTING SYSTEM AND PRINTING SYSTEM

(71) Applicant: TOSHIBA TEC KABUSHIKI KAISHA, Tokyo (JP)

(72) Inventors: Takayasu Aoki, Mishima Shizuoka (JP); Takafumi Hara, Nagaizumi Shizuoka (JP); Masahiro Ikuta, Mishima Shizuoka (JP); Tsuyoshi Itou, Izunokuni Shizuoka (JP); Kazuhisa Takeda, Kannami Shizuoka (JP); Yasuhito Noda, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/445,401

(22) Filed: Jul. 29, 2014

(51) Int. Cl.
*G03G 15/20* (2006.01)
*G03G 9/08* (2006.01)

(52) U.S. Cl.
CPC ..... *G03G 9/0821* (2013.01)

(58) Field of Classification Search
CPC ..... G03G 9/0821
USPC ..... 399/321
See application file for complete search history.

(56) References Cited

U.S. PATENT DOCUMENTS

| | | | |
|---|---|---|---|
| 7,945,189 | B2 | 5/2011 | Yamashita |
| 8,486,598 | B2 | 7/2013 | Aoki et al. |
| 2012/0321350 | A1 * | 12/2012 | Ogasawara |
| 2013/0164008 | A1 * | 6/2013 | Shimmura et al. |
| 2014/0170554 | A1 | 6/2014 | Aoki et al. |
| 2014/0248062 | A1 * | 9/2014 | Katayama |
| 2014/0255054 | A1 * | 9/2014 | Katayama |
| 2014/0255055 | A1 * | 9/2014 | Katayama |

* cited by examiner

*Primary Examiner* — Susan Lee
(74) *Attorney, Agent, or Firm* — Foley & Lardner LLP

(57) ABSTRACT

A toner set is used in a printing system that is capable of recycling a print medium and includes a first image forming portion which forms a toner image on the medium with a decolorable toner which is decolored by being heated at a temperature $T_e$ (° C.) or higher, a second image forming portion which forms a toner image on the medium with a non-decolorable toner and forms an image on the medium with at least one of the toners, and a decoloring apparatus provided with a heating portion which heats the medium on which a toner image is formed by the image forming apparatus at the temperature $T_e$ (° C.) or higher. When heated by the decoloring apparatus, the decolorable toner may be decolored without causing hot offset.

20 Claims, 3 Drawing Sheets

TONER SET FOR PRINTING SYSTEM AND PRINTING SYSTEM

BACKGROUND

In an information environment of an office, with the spread and adoption of computers, software, and networks, sharing of information and rapid processing thereof has become possible. Digitization of information is excellent from the viewpoint of storage, accumulation, search, and the like of the information. However, paper is a superior medium on which to display (in particular, perspicuity) and communicate information. For this reason, the amount of paper used is increasing even though digitization of information is growing. On the other hand, reduction of energy consumption represented by $CO_2$ emission is an urgent need in various fields. If the paper medium used for a temporary display or communication of information may be recycled, it may significantly contribute to the reduction of energy consumption.

If an image formed on the paper medium is erased, recycling of the paper medium is possible. Physical properties of such an erasable decoloring toner used on the paper medium are described in Japanese Patent No. 5213939. A decoloring toner allows reuse of paper sheets since it is possible to erase, i.e., decolor and thus render non-visible to the human eye, the image printed on the paper. This process is known in the art as "decoloring." An apparatus which may use an ordinary non-decoloring toner with such a decoloring toner in one image forming apparatus is needed.

DETAILED DESCRIPTION

Figure 1:
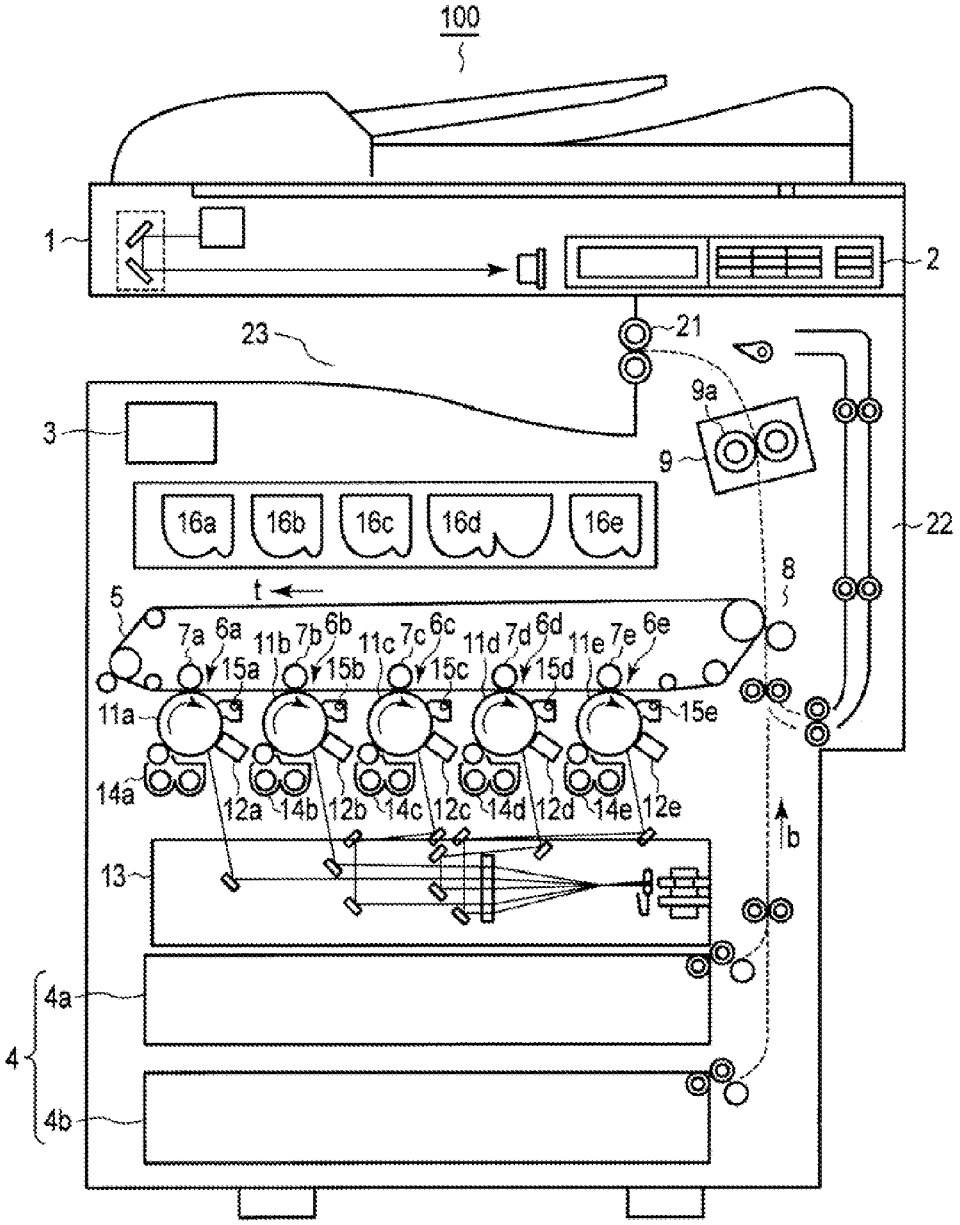
FIG. 1 is a schematic view showing a configuration example of an image forming apparatus in an image forming erasing system according to an exemplary embodiment.

According to one embodiment, a toner set of a printing system that uses a decoloring toner and a non-decoloring toner, and a printing system that may simplify an apparatus used for fixing a toner image or erasing (decoloring) an image are provided.

As used herein, an abnormal fixing of toner is referred to as an "offset." When the surface temperature of the heat transport member is much lower than the melting point of the toner and it causes insufficient fixing of the toner, this is referred to as a "cold offset." In contrast, when the surface temperature of the heat transport member is much higher than the melting point of the toner to cause surplus melting of toner, this is referred to as a "hot offset."

In general, according to one embodiment, in order to address the issues described above, there is provided a toner set which is used in a printing system that is capable of recycling a medium and includes an image forming apparatus which has a first image forming portion which forms a toner image on the medium with a decolorable toner which is decolored by being heated at a temperature $T_e$ (° C.) or higher, a second image forming portion which forms a toner image on the medium with non-decolorable toner and forms an image on the medium with at least one of the toners, and a decoloring apparatus provided with a heating portion which heats the medium on which a toner image is formed by the image forming apparatus, at the temperature $T_e$ (° C.) or higher. When heated by the decoloring apparatus, the decolorable toner may be decolored, without causing a hot offset, in a temperature range in which a temperature of the heating portion is greater than or equal to temperature $T_e$ (° C.) or and less than or equal to temperature $T1_U$ (° C.). In addition, when heating the medium on which an image is formed with the non-decolorable toner by the decoloring apparatus, the non-decolorable toner does not cause the hot offset at a temperature $T2_U$ (° C.) or lower, wherein a difference between the temperature $T_e$ and the temperature $T1_U$ is 20° C. or more, and $T1_U$ (° C.)<$T2_U$ (° C.).

In addition, according to another exemplary embodiment, there is provided a printing system that is capable of recycling a print medium and includes an image forming apparatus which has a first image forming portion which forms a toner image on the medium with a decolorable toner which is decolored by being heated at a temperature $T_e$ (° C.) or higher and a second image forming portion which forms a toner image on the medium with a non-decolorable toner, and which forms an image on the medium with at least one of the toners, and a decoloring apparatus provided with a heating portion which heats the medium on which a toner image is formed by the image forming apparatus at the temperature $T_e$ (° C.) or higher, in which when being heated by the decoloring apparatus, the decolorable toner may be decolored, without causing hot offset, in a temperature range in which a temperature of the heating portion is in a temperature range greater than or equal to temperature $T_e$ (° C.) and less than or equal to temperature $T1_U$ (° C.), and when heating the medium on which an image is formed with the non-decolorable toner by the decoloring apparatus, the non-decolorable toner does not cause the hot offset at a temperature $T2_U$ (° C.) or lower, wherein a difference between the temperature $T_e$ and the temperature $T1_U$ is 20° C. or more, and $T1_U$ (° C.)<$T2_U$ (° C.).

Hereinafter, exemplary embodiments will be described with reference to the drawings.

A printing system according to an exemplary embodiment is capable of forming and erasing of an image, so-called, an image forming erasing system. FIG. 1 is a schematic configuration view of an image forming apparatus included in a printing system according to the exemplary embodiment. MFP (Multi Functional Peripheral) 100 is an image forming apparatus using a tandem process. MFP 100 is provided with a scanner 1 which scans an original document in an upper portion, a control panel 2 as an operating portion, and a control portion 3 which controls the overall operation of the MFP 100. A sheet feeding portion 4 is arranged below the MFP 100. For example, the sheet feeding portion 4 has accommodating portions 4*a* and 4*b* which accommodate therein sheets having different sizes which are used as a medium onto which the MFP 100 prints images. An intermediate transfer belt 5 movable in the direction of an arrow t, and five image forming portions 6*a*, 6*b*, 6*c*, 6*d* and 6*e* arranged around the intermediate transfer belt 5 are located in a position between the scanner 1 and the sheet feeding portion 4.

The image forming portions 6*a*, 6*b*, 6*c*, 6*d* and 6*e* form an image by a decolorable blue toner which is a decoloring recording material having an erasing (decoloring) capability (hereinafter, referred to as "E toner" in some cases), a non-decolorable yellow toner which is a non-decoloring recording material not having decoloring capability (hereinafter, referred to as "Y toner" in some cases), a non-decolorable magenta toner (hereinafter, referred to as "M toner" in some cases), a non-decolorable cyan toner (hereinafter, referred to as "C toner" in some cases), and a non-decolorable black toner (hereinafter, referred to as "BK toner" in some cases), respectively. Here, the image forming portion 6*a* provided with a decoloring toner is a first image forming portion, and the image forming portions 6*b*, 6*c*, 6*d* and 6*e* provided with a non-decoloring toner form a second image forming portion.

Moreover, the decolorable toner decolors when reaching a certain temperature (decolorable temperature) by heating thereof, and it is possible to cause a reversible coloring reaction of the decolored toner at a specific temperature (the color-recovering or recoloring temperature) or less when the temperature is decreased. For example, a decolorable toner begins to decolor at 90° C., and completely decolors at 95° C., and the decoloring temperature is a temperature range in which the decoloring occurs in this manner. The components of the decoloring toner and manufacturing method thereof will be described in detail along with a description of the components and manufacturing method of a non-decoloring toner further herein.

Moreover, the "decoloring" in the exemplary embodiment means to make an image formed with a color (including not only chromatic color but also achromatic color such as white and black) different from the color of a sheet base to be not visible, on the sheet, to the human eye.

Transfer rollers 7*a*, 7*b*, 7*c*, 7*d* and 7*e* combine with rollers 11*a-e* to selectively maintain the intermediate transfer belt 5 positioned against drums 11*a-e*, such that a latent image formed on one or more of rollers 11*a-e* of the image forming portions 6*a*, 6*b*, 6*c*, 6*d* and 6*e* are transferred onto the intermediate transfer belt. A secondary transfer roller 8, arranged downstream of the image forming portion 6*e* along the movement direction of the intermediate transfer belt 5, forms. With the transfer portion a nip through which a sheet of print media may pass to transfer a toner image formed by at least one of the image forming portions 6*a*, 6*b*, 6*c*, 6*d* and 6*e* on the intermediate transfer belt 5 onto a sheet fed from a sheet feeding portion 4. A fixing portion 9 for fixing the toner image to the sheet is disposed downstream of the secondary transfer roller 8 along the traveling direction (the direction of an arrow b) of the sheet fed from the sheet feeding portion 4.

The fixing portion 9 is provided with a heat transport member 9*a* for forming a nip and configured for transporting the sheet on which the toner image is transferred. The heat transport member 9*a* fixes the toner image to the sheet by heating the sheet on which the toner image is transferred to a predetermined fixing temperature. In order to fix the toner image to the sheet at the fixing portion 9, the temperature higher than the glass transition temperature $T_g$ of a binder resin included in the toner, and around the softening point $T_m$ of the toner, is generally required. Also, if the fixing temperature is lower than the decoloring temperature of the decolorable toner when fixing the toner image including the decoloring toner to the sheet, the color of the toner image will not be decolored.

Since the configuration of the image forming portions 6*a*, 6*b*, 6*c*, 6*d*, and 6*e* is common except for the toner accommodated inside, the configuration of the image forming portions 6*a*, 6*b*, 6*c*, 6*d*, and 6*e* will be described as an example of the image forming portion 6*a*.

The image forming portion 6*a* has a photoconductor drum 11*a* as an image carrier, i.e., a surface onto which an electrostatic pattern representing the to be printed image or a portion thereof is written, wherein toner is dispersed thereonto and forms a pattern thereon based on the electrostatic image pattern. Around the photoconductor drum 11*a*, a charger 12*a* for charging the photoconductor drum 11*a*, an exposure device 13 for irradiating the charged photoconductor drum 11*a* with a scanning line of a laser beam in accordance with the image information, and a developing device 14*a* which accommodates the decolorable E toner and develops the electrostatic latent image formed by the exposure device 13 with toner are arranged. Further, the image forming portion 6*a* has a cleaning device 15*a* for removing the toner remaining on the photoconductor drum 11*a* after the toner image on the photoconductor drum 11*a* is transferred by the transfer roller 7*a* to the transport belt 5.

In the same manner, the image forming portions 6*b*, 6*c*, 6*d* and 6*e* have the photoconductor drums 11*b*, 11*c*, 11*d*, and 11*e*, the chargers 12*b*, 12*c*, 12*d*, and 12*e*, the exposure device 13, the developing devices 14*b*, 14*c*, 14*d*, and 14*e*, and the cleaning devices 15*b*, 15*c*, 15*d*, and 15*e*. The toner accommodated in the developing device 14*b* is the non-decolorable Y toner, the toner accommodated in the developing device 14*c* is the non-decolorable M toner, the toner accommodated in the developing device 14*d* is the non-decolorable C toner, the toner accommodated in the developing device 14*e* is the non-decolorable BK toner.

In the developing devices 14*a*, 14*b*, 14*c*, 14*d*, and 14*e*, each accommodated toner density is detected, and depending on the toner density, the toner is supplied from toner cartridges 16*a*, 16*b*, 16*c*, 16*d*, and 16*e* corresponding to the toner which each developing device accommodates.

The image forming portions 6*a*, 6*b*, 6*c*, 6*d*, and 6*e* may be changed depending on an image forming (hereinafter, also referred to as "printing") type, that is, printing with the decoloring toner having the decoloring function, and with the non-decoloring toner not having the decoloring function. When printing with the decolorable toner having the decoloring function, in order to prevent color mixing with the non-decolorable toner, the image forming portion 6*a* (photoconductor drum 11*a*) comes into contact with the intermediate transfer belt 5, and the image forming portions 6*b*, 6*c*, 6*d*, and 6*e* (photoconductor drums 11*b*, 11*c*, 11*d*, and 11*e*) do not come into contact with the intermediate transfer belt 5. When printing with the decolorable toner having the decoloring capability, the temperature of the fixing portion 9 (hereinafter, referred to as the fixing temperature) is lower than the decoloring temperature of the decolorable toner, and is maintained at a fixing temperature of the decolorable toner. For example, the decolorable toner is fixed at 70° C. to 90° C., and the fixing temperature refers to a temperature range in which such a fixing occurs.

On the other hand, when printing with the non-decolorable toner not having the decoloring function, the image forming portions 6*b*, 6*c*, 6*d*, and 6*e* (photoconductor drum 11*b*, 11*c*, 11*d*, and 11*e*) come into contact with the intermediate transfer belt 5, and the decolorable image forming drum 11*a* does not come into contact with the intermediate transfer belt 5. In this case, the temperature of the fixing portion 9 is controlled to a temperature equal to or higher than the fixing temperature of the non-decolorable toner. In general, the fixing temperature of the non-decolorable toner is equivalent to the fixing temperature of the decolorable toner, and in some cases, the temperature at which the fixing begins is higher than that of the decolorable toner.

In the fixing portion 9, a first image formed with the decolorable toner and a second image formed with the non-decolorable toner are formed on the sheet, either on the same or different sheets.

In the sheet transfer path, a flapper (bifurcation member) is provided downstream of the fixing portion 9, the flapper guides the sheet in the direction of a sheet discharge roller 21 or in the direction of a retransport unit 22. A sheet introduced to the sheet discharge roller 21 is discharged to a sheet discharging portion 23. In addition, A sheet introduced to the retransport unit 22 is again introduced in the direction of the secondary transfer roller 8.

Moreover, since the image forming apparatus shown in FIG. 1 is a color MFP, a color image using the image forming portions 6*b*, 6*c*, 6*d*, and 6*e* using the non-decolorable recording material are included in the second image forming portion, and the image forming apparatus including only the image forming portions 6*a*, and 6*e*, and using only the decolorable E toner and the non-decolorable BK toner, may also be used.

In the exemplary embodiment described above, the toners are described as the decolorable recording material and the non-decolorable recording material, and it is also possible to form an image using a liquid ink, a gel-state ink, an ink ribbon, or the like in accordance with the form of the image forming apparatus using the teachings hereof. In addition, the MFP 100 of the exemplary embodiment may be configured to have a function of a decoloring apparatus 200 described later. In this case, the MFP 100 itself is referred to as the image forming erasing system, and using the fixing portion 9 included in the MFP 100, it is possible to decolor a decolorable recording material on the sheet.

On the sheet printed with the decolorable recording material using the image forming apparatus such as the MFP 100, for example, by using an image erasing apparatus 200 described below, it is possible to decolor the decolorable recording material previously fixed on the sheet. When the image erasing apparatus 200 is used, the image forming erasing system includes the above-described MFP 100 and the erasing (decoloring) apparatus 200.

Figure 2:
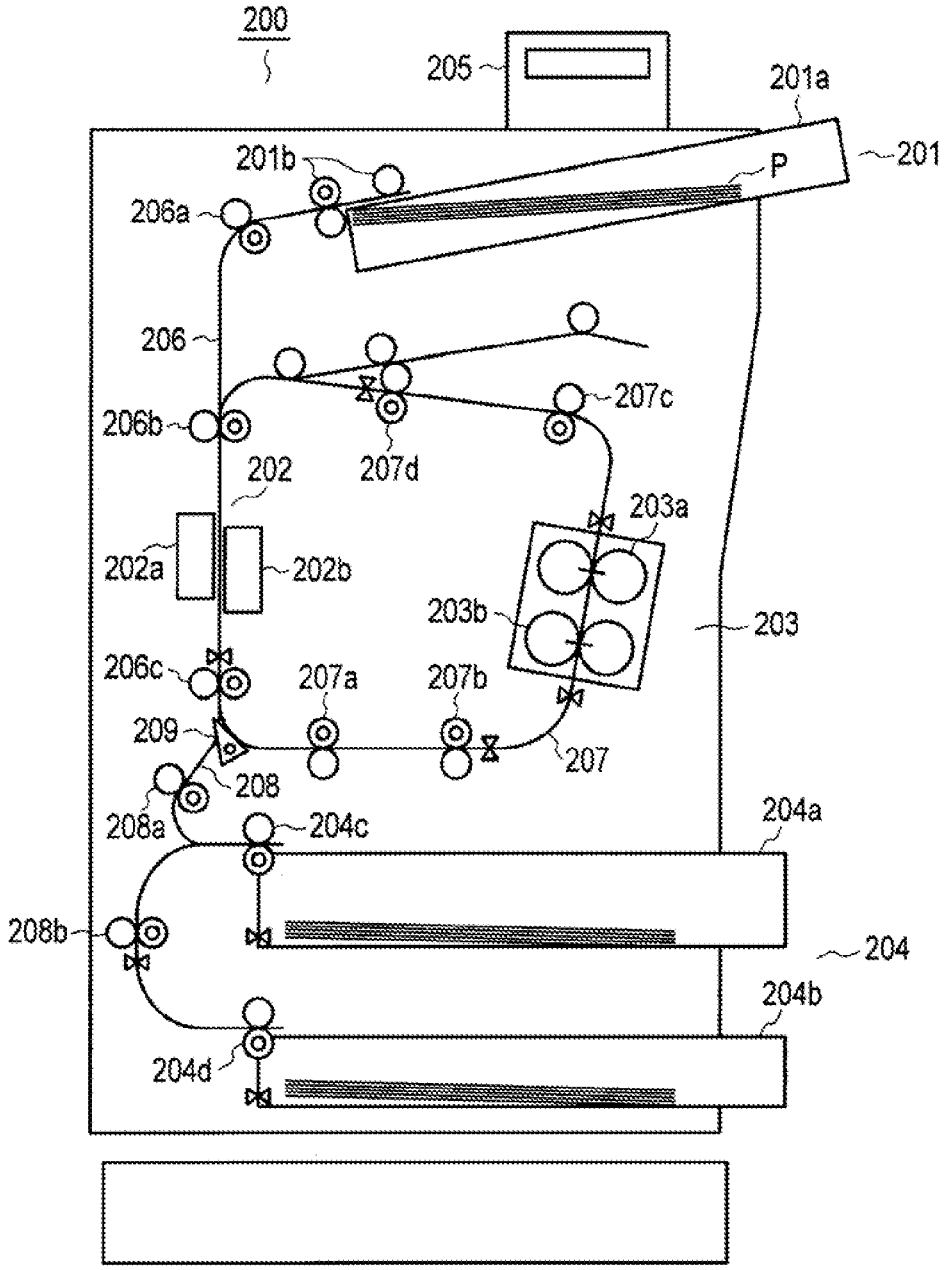
FIG. 2 is a schematic view showing a configuration example of an image erasing apparatus in the image forming erasing system according to an exemplary embodiment.

FIG. 2 is a schematic diagram showing the entire configuration of the erasing apparatus 200. For example, the image erasing apparatus 200 is an apparatus which decolors the toner image on a sheet P printed with the above-described decolorable recording material of the image forming apparatus 100, for example, the decolorable toner or the decolorable ink by heating or the like. The image erasing apparatus 200 is provided with an operation portion 205 for operating or requesting processes of a sheet feeding portion 201, a reading portion 202, a decoloring portion 203, a discharged sheet storage portion 204 and the erasing apparatus 200.

The sheet feeding portion 201 is provided with a sheet feeding tray 201*a* and a sheet feeding and transport rollers 201*b*. In the sheet feeding tray 201*a*, one or more sheets P which is, for example, printed with the decolorable recording material, is stacked. In some cases, a sheet, for example, printed with the non-decolorable recording material is also stacked in the sheet feeding tray 201*a*. For processing thereon, the sheet P is sent to a first transport path 206 through the sheet feeding and transport roller 201*b*, and sent to the reading portion 202 through the transport rollers 206*a* and 206*b*.

The reading portion 202 is provided with a surface reading portion 202*a* for reading the surface (first surface) of the sheet P transported and a back surface reading portion 202*b* for reading the back surface (second surface) of the sheet P. Information read here is stored in the erasing apparatus. Alternatively, the read information is stored in another storage apparatus through a communication line.

The sheet P having an image thereon read by the reading portion passes through the reading portion 202, then passes through a transport roller 206*c*, is directed to a second transport path 207 by a flapper (bifurcation member) 209, and is sent to the decoloring portion 203 through transport rollers 207*a* and 207*b*.

The decoloring portion 203 is provided with first and second heat transport members 203*a* and 203*b* for nipping and transporting the sheet P. The first and second heat transport members 203*a* and 203*b* decolor the image or the like printed on either side of the sheet P by heating the sheet P to a predetermined decoloring temperature. In order to decolor the color of the decolorable toner, it is necessary to heat the toner to a decoloring temperature of the decolorable toner.

The temperature of the decoloring portion 203 in the erasing apparatus 200 is higher than that of the fixing temperature of the fixing portion in the image forming apparatus, and when decoloring, hot offset (transfer of the toner image to the rollers in the decoloring portion 203) of the toner should be avoided. Because sheets having both decolorable and non-decolorable toner images may pass through the erasing apparatus, it is necessary to consider hot offset with respect to both the decolorable toner and the non-decolorable toner. Hot offset will be described below, and in this exemplary embodiment, the hot offset characteristics of the decolorable toner and the non-decolorable toner constituting the toner set are defined such that hot offset does not occur when decoloring.

The sheet P, having passed through the decoloring portion 203, is transported again to the reading portion 202 through the transport rollers 207*c*, 207*d*, and 206*b*. Here, the sheet P is read again, and it is determined whether or not an unerased part, or sheet damage such as tearing or creasing is present on the sheet, and thus whether or not the sheet is reusable.

The discharged sheet storage portion 204 is provided with a reusable sheet storage tray 204*a* and a unreusable sheet storage tray 204*b*. The sheet P, having been read again in the reading portion 202, then passes through the transport roller 206*c*, and is sent to a third transport path 208 by a flapper (bifurcation member) 209. A sheet P1 determined to be reusable passes through a transport roller 208*a*, and is discharged to the reusable sheet storage tray 204*a* through a sheet discharging and transport rollers 204*c* by a flapper. On the other hand, when a sheet P2 is determined to be unreusable, the sheet discharging and transport rollers 204*c* are reversed, and the sheet P2 is discharged to a unreusable sheet storage tray 204*b* through the transport rollers 208*b*, and the sheet discharging and transport rollers 204*d*.

Moreover, as between the reusable sheet storage tray 204*a* and the unreusable sheet storage tray 204*b*, the type of sheet to be received therein can be changed (switched). The setting of the transport destination of the sheet P based on its erased condition, for example, may be set at the operation portion 205.

When forming an image on a sheet by using the image forming apparatus shown in FIG. 1, in the fixing portion 9, in some cases a part of the toner is transferred to the rollers used as the heat transport member 9*a*. When decoloring the decolorable recording material on a sheet by using the erasing apparatus shown in FIG. 2, in the decoloring portion 203, in the same manner, a part of the toner may in some cases be transferred to the rollers used as the heat transport members 203*a* and 203*b*. Such a transfer of the toner is referred to as an offset, and in particular, when the surface temperature of the roller is lower than the melting point of the toner, the transfer is referred to as a cold offset. In contrast, when the surface temperature of the roller is higher than the melting point of the toner, the transfer is referred to as hot offset.

In the exemplary embodiment, the decoloring temperature of the decoloring portion is higher than the fixing temperature of the fixing portion. In order to prevent occurrence of the offset when fixing, each of the cold offset occurrence temperature and the hot offset occurrence temperature of the toner is required to satisfy the following conditions.

Decolorable Toner

Cold offset occurrence temperature<fixing temperature<decoloring temperature<hot offset occurrence temperature Non-decolorable Toner Cold offset occurrence temperature<fixing temperature<hot offset occurrence temperature In order to prevent occurrence of the offset when erasing, both the hot offset occurrence temperature of the decolorable toner and the hot offset occurrence temperature of the non-decolorable toner are required to be higher than the decoloring temperature of the decoloring portion.

In general, temperature fluctuations occur near the heat transport member in the fixing portion of the image forming apparatus, and the temperature fluctuations occur also occur near the heat transport member in the decoloring portion of the erasing apparatus. In addition, temperature variation also occurs across the sheet to be printed. A temperature at which printing is possible without discoloring the decolorable toner, and fixing is possible without offsetting both the decolorable toner and the non-decolorable toner is required to have a sufficient width (fixing margin temperature width). A temperature at which an erasable image may be erased (decolored) without offsetting both the decolorable toner and the non-decolorable toner is also required to have a sufficient width (decoloring margin temperature width).

Moreover, when performing printing using an image forming apparatus provided with both the image forming portion using the decolorable toner and an image forming portion using the non-decolorable toner, the erasable image including the decolorable toner and the unerasable image including the non-decolorable toner are not necessarily formed on the same medium. Both a medium on which only the erasable (decolorable) image is formed and a medium on which only the unerasable (non-decolorable) image is formed are present.

Regardless of the types of the formed images, that is, without discrimination of recorded media, a medium on which only an erasable image is formed and a medium on which only unerasable image is formed are provided to the same decoloring apparatus in many cases. Thermal properties (the temperature at which the hot offset occurs) of the decolorable toner are different from those of the non-decolorable toner, and thus even when decoloring the decolorable toner is excellently performed, hot offset of the non-decolorable toner occurs in some cases. In this case, the decoloring apparatus is stained, and thus trouble occurs in the decoloring process.

In the toner set of the exemplary embodiment, a temperature range (decoloring non offsetting range) in which the decolorable toner is not offset when decoloring an image formed thereof, and a temperature range (non-offsetting range) in which the non-decolorable toner is not offset when fixing have an overlap of 20° C. or more. It is preferable that the temperature range (fixing non-offsetting range) in which the decolorable toner is printable and the offset does not occur when fixing and the non-offsetting range of non-decolorable toner have an overlap of 20° C. or more. Such a relationship between the temperatures will be described with reference to the drawings.

Figure 3:
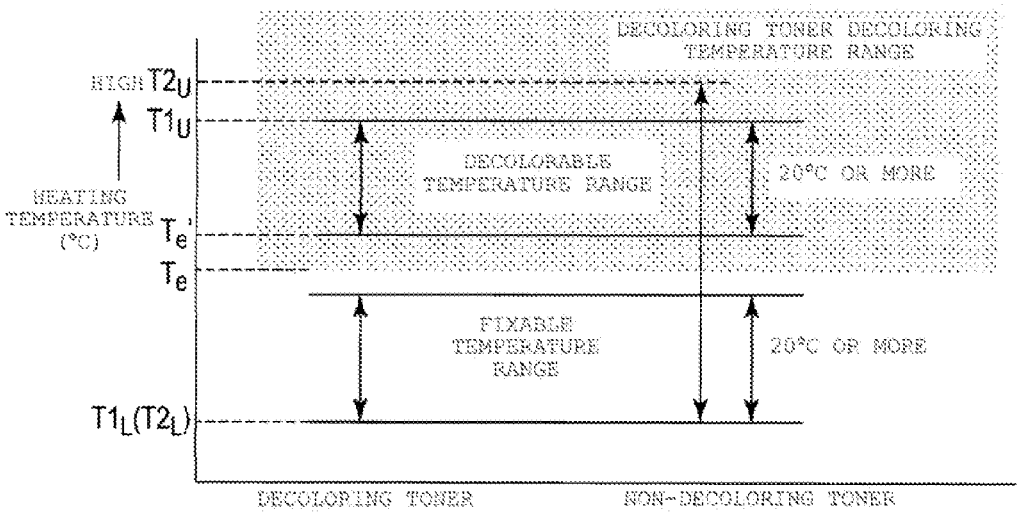
FIG. 3 is a diagram illustrating temperature characteristics of a toner set according to an exemplary embodiment.

The diagram of FIG. 3 shows an example of the temperature characteristics of the decolorable toner and the non-decolorable toner in the toner set of the exemplary embodiment. The vertical axis represents the heating temperature of the decolorable apparatus. The range shown for non-decolorable toner corresponds to the non-offsetting range thereof ($T2_L$ to $T2_U$). For the non-decolorable toner, at a temperature lower than the temperature $T2_L$, cold offset occurs, and at a temperature higher than the temperature $T2_U$, hot offset occurs. The temperature $T2_L$ and the temperature $T2_U$ are set as the cold offset occurrence temperature and the hot offset occurrence temperature of the non-decolorable toner, respectively.

As physical properties of the toner, the decolorable toner has a property of decoloring at a temperature $T_e$ or higher. Therefore, the temperature of the heating portion for heating the toner in the decoloring apparatus is necessary to be set to a temperature $T_e$ or higher. The temperature of the heating portion is preferably set to $T_e'$ (° C.) which is 5° C. or more higher than $T_e$, and more preferably set to $T_e'$ (° C.) which is 10° C. or more higher than $T_e$.

For the decolorable toner, the decoloring temperature range is present at a higher temperature than the fixable temperature range as shown in the drawing. Here, "fixable" means that the decolorable toner image is fixed in a colored state. In the following description, it is assumed that "fixing" of the decolorable toner is in a colored state. The fixing temperature when fixing is set within the fixable temperature range, and the decoloring temperature when the apparatus is decoloring is set within the decolorable temperature range. For the decolorable toner, at a temperature higher than the temperature $T1_U$, hot offset occurs, and at a temperature lower than the temperature $T1_L$, cold offset occurs. The temperature $T1_U$ and the temperature $T1_L$ are the hot offset occurrence temperature and the cold offset occurrence temperature of the decoloring toner, respectively.

In an exemplary embodiment, the difference between the hot offset occurrence temperature $T1_U$ and the temperature $T_e$ of the decolorable toner is set to 20° C. or more, and this difference is preferably 30° C. or more. Moreover, in the FIG. 3, it is shown that the difference between the hot offset occurrence temperature $T1_U$ and the temperature $T_e'$ of the decoloring toner is 20° C. or more. As described above, since the temperature $T_e'$ is 5° C. or more higher than the temperature $T_e$, it may be seen from FIG. 3 that the difference between $T1_U$ and $T_e$ is 20° C. or more.

In the example shown in FIG. 3, the cold offset occurrence temperature $T1_L$ of the decolorable toner is about the same as the cold offset occurrence temperature $T2_L$ of the non-decolorable toner, however, the cold offset occurrence temperature $T1_L$ of the decolorable toner is not necessarily limited to this. In some cases, the cold offset occurrence temperature $T1_L$ of the decolorable toner is different from the cold offset occurrence temperature $T2_L$ of the non-decolorable toner.

For the decolorable toner, the range from the decoloring temperature to the hot offset occurrence temperature $T1_U$ is defined as the decoloring non-offsetting range, and the range from the cold offset occurrence temperature $T1_L$ to the hot offset occurrence temperature $T1_U$ is defined as the (coloring) fixing non-offsetting range. Moreover, considering the hot offset occurrence, the upper limit of the fixing non-offsetting range of the decolorable toner is the hot offset occurrence temperature $T1_U$, and the fixing temperature is set to less than the decoloring temperature such that the color of the decolorable toner is not decolored when fixing.

In order to decolor the color of the decolorable toner, it is necessary to heat the toner to the decoloring temperature or higher. The temperature range higher than the decoloring temperature is defined as "decoloring toner decoloring temperature range".

Figure 4:
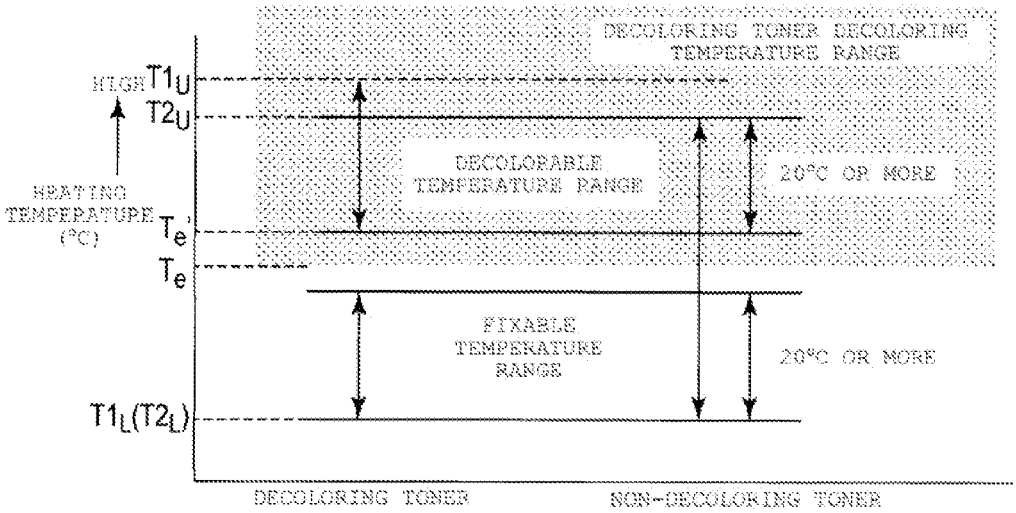
FIG. 4 is a diagram illustrating the temperature characteristics of a toner set according to another exemplary embodiment.

FIG. 3 shows a case where the hot offset occurrence temperature $T1_U$ of the decolorable toner is lower than the hot offset occurrence temperature $T2_U$ of the non-decolorable toner, and as shown in FIG. 4, the hot offset occurrence temperature $T1_U$ of the decolorable toner is higher than the hot offset occurrence temperature $T2_U$ of the non-decolorable toner. Moreover, in some cases, the hot offset occurrence temperature $T1_U$ of the decolorable toner is almost the same as the hot offset occurrence temperature $T2_U$ of the non-decolorable toner.

In this case, the difference between the hot offset occurrence temperature $T2_U$ and the temperature $T_e$ of the decolorable toner is set to 20° C. or more, and this difference is preferably 30° C. or more. Moreover, in FIG. 4, it is shown that the difference between the hot offset occurrence temperature $T2_U$ and the temperature $T_e'$ of the decolorable toner is 20° C. or more. As described above, since the temperature $T_e'$ is 5° C. or more higher than the temperature $T_e$, it may be seen from FIG. 4 that the difference between $T2_U$ and $T_e$ is 20° C. or more.

In the system using a plurality of non-decolorable toners such as color toners in the related art, in order to avoid offset, the kind and ratio of the binder resin or release agent is the same across the different toners, and only the color forming agent such as a pigment is changed. In the decolorable toner used in the exemplary embodiment, in order to ensure the desired image density, it is required that the quantity of the decolorable colorant material be greater than that of the colorant used in the non-decolorable toner. As a result, it is difficult to cause the kind of, and ratio of, the binder resin or release agent contained in the decolorable toner be the same as that of the non-decolorable toner.

The present inventors have determined an optimal combination of the decolorable toner and the non-decolorable toner for use in the same image forming apparatus. In the toner set of the exemplary embodiment, the offset characteristics when the decolorable toner is decolored and the offset characteristics when the non-decolorable toner is fixed are about the same. Specifically, in the toner set of the exemplary embodiment, the overlap (decoloring margin temperature width) between the decoloring non-offsetting range of the decolorable toner and the non-offsetting range of the non-decolorable toner is 20° C. or more. In other words, both the hot offset occurrence temperature of the decolorable toner and the hot offset occurrence temperature of the non-decolorable toner are 20° C. or more higher than the decoloring temperature.

By using the toner set of the exemplary embodiment, it is possible to erase (decolor) an erasable image formed with the decolorable toner without occurrence of hot offset of any toner as among the decolorable toner and non-decolorable toner. For example, in order to erase (decolor) an erasable image in the image forming erasing system including the image forming apparatus shown in FIG. 1 and the erasing apparatus 200 shown in FIG. 2, a sheet on which an erasable image is formed is accommodated in the sheet feeding tray 201*a* of the erasing apparatus 200 along with a sheet on which an unerasable image is formed.

The sheet on which an erasable image is formed is transported in the erasing apparatus as described above, and the image is erased by the decoloring portion 203 at a temperature greater than the decoloring temperature but below the offset temperature, i.e., within the non-offsetting range. The hot offset occurrence temperature ($T1_U$) of the decoloring toner is higher than the decoloring temperature of the decoloring portion 203, and thus when the image is erased, hot offset of the decoloring toner does not occur.

The sheet on which an unerasable image is formed is also sent to the transport path before or after the sheet on which an erasable image is formed, and it reaches the decoloring portion 203 and is exposed to the decoloring temperature. The hot offset occurrence temperature ($T2_U$) of the non-decolorable toner is also higher than the decoloring temperature of the decoloring portion 203, and thus the hot offset of the non-decolorable toner does not occur. Furthermore, both the hot offset occurrence temperature of the decolorable toner and the hot offset occurrence temperature of the non-decolorable toner are 20° C. or more higher than the decoloring temperature, and the decoloring margin temperature width is 20° C. or more. Thus, even when fluctuations in the temperature of the sheet transported to the decoloring portion occur, it is possible to avoid the occurrence of the hot offset which causes abnormal fixing and the image density of the fixed image to be uneven.

An unerasable image and an erasable image may be formed on the same sheet. Even when erasing the erasable image from such sheet, for the reasons described above, it is possible to avoid the occurrence of hot offset of the decolorable toner and the non-decolorable toner. Also in the image forming apparatus provided with an erasing apparatus, it is possible to erase the erasable image from such sheet without occurrence of the offset of the toner. However, in this case, the temperature of the fixing portion 9 which functions as the erasing apparatus is set to the decoloring temperature of the decolorable toner.

In the toner set (decolorable and non-decolorable toners) of the exemplary embodiment, both the cold offset occurrence temperature of the decolorable toner and the cold offset occurrence temperature of the non-decolorable toner are preferably lower than the fixing temperature, and in addition, the overlap (fixing margin temperature width) between the fixing temperature non-offsetting range in which the decolorable toner is printable and the non-offsetting range of the non-decolorable toner is preferably 20° C. or more. In other words, both the cold offset occurrence temperature of the decolorable toner and the cold offset occurrence temperature of the non-decolorable toner are 20° C. or more lower than the decoloring temperature.

In this case, it is possible to fix a toner image including the decolorable toner and a toner image including the non-decolorable toner on the same sheet in the same temperature range, and cold offset does not occur in either the decolorable toner and non-decolorable toner when fixing thereof. Even when fluctuations in the temperature of the sheet transported to the fixing portion occur, it is possible to avoid the occurrence of offset which causes abnormal fixing and the image density of the fixed image to be uneven.

Using the toner set of the exemplary embodiment, it is possible to perform formation of an image by using the decolorable toner and the non-decolorable toner, and erasure of an image formed with the decoloring toner in one image forming erasing system, and it is possible to simplify the apparatus used for fixing and/or erasing. In particular, when forming an image using the decolorable toner and the non-decolorable toner, it is possible to perform fixing of both under the same temperature conditions.

Hereinafter, the decolorable toner and the non-decoloring toner in the toner set of the exemplary embodiment will be described.

The decolorable toner includes an electron donating coloring agent, an electron receptive color developing agent, a decoloring temperature control agent, and a binder resin. The decoloring mechanism of the decolorable toner is as follows.

When the electron donating coloring agent which is a leuco dye represented by CVL (crystal violet lactone) is bonded to the electron receptive color developing agent represented by a phenolic compound, coloring occurs, and when dissociated, decoloring occurs. If material having a large temperature difference between the melting point and the freezing point called the decoloring temperature control agent, in addition to the coloring agent and the color developing agent is present, when heating is performed to the melting point or higher of the decoloring temperature control agent, decoloring occurs, and when the freezing point is room temperature or lower, a coloring material which maintains the decoloring state even at room temperature is obtained. In this exemplary embodiment, colorable and decolorable coloring materials in which the electron donating coloring agent, the electron receptive color developing agent, and the decoloring temperature control agent are encapsulated are preferably used as the decolorable toner.

The electron donating coloring agent is a precursor compound of a coloring material for displaying characters or graphics. As the electron donating coloring agent, a leuco dye may be mainly used. The leuco dye is an electron donating compound capable of coloring by the color developing agent. Examples of the coloring compound include diphenylmethanephthalides, phenylindolylphthalides, indolylphthalides, diphenylmethaneazaphthalides, phenylindolylazaphthalides, fluorans, styrylquinolines, and diazarhodaminelactones.

Specifically, 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide may be exemplified. Further, pyridine-based compounds, quinazoline-based compounds and bisquinazoline-based compounds may be exemplified. These may be used in a mixture of two or more kinds thereof.

The electron receptive color developing agent is a compound which makes a coloring compound color by donating a proton to the leuco coloring matter. Examples of the electron receptive color developing agent include phenols, phenol metal salts, carboxylic acid metal salts, aromatic carboxylic acids, and aliphatic carboxylic acid having 2 to 5 carbon atoms, benzophenones, sulfonic acid, sulfonate, phosphoric acids, phosphoric acid metal salts, acid phosphoric acid ester, acidic phosphoric acid ester metal salts, phosphorous acids, phosphorous acid metal salts, monophenols, polyphenols, 1,2,3-triazole and derivatives thereof. These compounds may include an alkyl group, an aryl group, an acyl group, an alkoxycarbonyl group, a carboxyl group and the esters thereof or an amide group, and a halogen group as a substituent. In addition, bis- and tris-type phenols or the like, phenol-aldehyde condensation resins or the like, and metal salts thereof may be used as the electron receptive color developing agent.

Specifically, phenol, o-cresol, tertiary butyl catechol, nonylphenol, n-octyl phenol, n-dodecyl phenol, n-stearyl phenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof, for example, 2,3-dihydroxybenzoic acid, methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethylpropionate, 2,2-bis(4-hydroxyphenyl)-4-methylpentane, 2,2-bis(4-hydroxyphenyl)hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylene tris-p-cresol may be exemplified.

The above-described electron receptive color developing agent may be used alone, or in a mixture of two or more kinds thereof.

As the decoloring temperature control agent used in the exemplary embodiment, in the three-component system of the coloring compound, the color developing agent, and the decoloring temperature control agent, any compound may be used as long as it may inhibit the coloring reaction by the coloring compound and the color developing agent by heat, and thus it may make colorlessness.

As the decoloring temperature control agent, for example, decoloring temperature control agents disclosed in JP-A-60-264285, JP-A-2005-1369, JP-A-2008-280523, and the like may be used. The decoloring temperature control agents described here have a coloring and decoloring mechanism using thermal hysteresis, and are excellent in terms of an instantaneous erasability.

When a colored mixture including the electron donating coloring agent, the electron receptive color developing agent. and the decoloring temperature control agent is heated to a specific decoloring temperature, it is possible to decolor the mixture. Even when the decolored mixture is cooled to a temperature equal to or below the decolorable temperature, the decolored state is maintained. When the temperature is further lowered, it is possible to cause a reversible coloring and decoloring reaction in which a coloring reaction by the coloring agent and the color developing agent is recovered again at a temperature equal to or below a specific color recovering temperature (the recoloring temperature), and the state of the mixture is returned to a colored state.

In the exemplary embodiment, the decoloring temperature is preferably higher than room temperature, and the recovering temperature is preferably lower than room temperature. The decoloring temperature control agent that may achieve the conditions is appropriately selected. Examples of the decoloring temperature control agent capable of causing the temperature hysteresis include alcohols, esters, ketones, ethers, and acid amides.

As the decoloring temperature control agent, esters are particularly preferable. Specifically, examples of suitable esters include carboxylic acid ester including a substituted aromatic ring, ester obtained from a reaction of carboxylic acid including an unsubstituted aromatic ring and aliphatic alcohol, carboxylic acid ester including a cyclohexyl group in a molecule, ester obtained from a reaction of fatty acid and an unsubstituted aromatic alcohol or phenol, ester obtained from a reaction of fatty acid and branched aliphatic alcohol, ester obtained from a reaction of dicarboxylic acid and aromatic alcohol or branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used alone, or in a mixture of two or more kinds thereof.

Using the electron donating coloring agent, the electron receptive color developing agent, and the decoloring temperature control agent as described above, a coloring material included in the decolorable toner is obtained.

As the binder resin, polyester-based resins obtained by polycondensation through an esterification between a dicarboxylic acid component and a diol component is desirable. Since in general, the glass transition temperature of the polyester-based resins is lower than that of the styrene-based resins, the polyester-based resins are advantageous from the viewpoint of low temperature fixing. Examples of the acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylol propane, and pentaerythritol; alicyclic diols such as 1,4-cyclohexane diol and 1,4-cyclohexanedimethanol; and ethylene oxide or propylene oxide adduct such as bisphenol A.

In addition, using polyvalent carboxylic acid or a polyol component of trivalent or more such as 1,2,4-benzene tricarboxylic acid (trimellitic acid) or glycerin, the polyester component described above may be made to be a crosslinked structure.

In addition, polyester resins of two or more kinds having different compositions may be used in combination.

The polyester resin may be amorphous and crystalline. The glass transition temperature of the polyester resin is desirably 35° C. or higher and 70° C. or lower. When the glass transition temperature is 35° C. or higher, the heat resistant preservability of the toner is excellent, and gloss of the resin on the sheet after erasing the image is not visually observed. In contrast, when the glass transition temperature is 70° C. or lower, the low temperature fixability is maintained, and the erasability when heating to the decoloring temperature is also not poor. The glass transition temperature of the polyester resin is desirably 50° C. or higher and 65° C. or lower.

The toner of the exemplary embodiment may further include the following components.

Release Agent

Examples of the release agent include aliphatic hydrocarbon-based waxes such as low molecular weight polyethylene, low molecular weight polypropylene, a polyolefin copolymer, a polyolefin wax, a paraffin wax, a Fischer-Tropsch wax, and modified products thereof, vegetable-based waxes such as a candelilla wax, a carnauba wax, a Japanese wax, a jojoba wax, and a rice wax, animal-based waxes such as a beeswax, lanolin, and spermaceti; mineral-based waxes such as a montan wax, an ozocerite, and ceresin; fatty acid amides such as linoleic acid amide, oleic acid amide, and lauric acid amide, a functional synthetic wax, and silicone-based waxes.

From the viewpoint of low temperature fixability, the softening point of the release agent is preferably 50° C. to 120° C., and more preferably 60° C. to 110° C.

In particular, the release agent preferably has an ester bond of components including an alcohol component and a carboxylic acid component. As the alcohol component, higher alcohols may be exemplified, and as the carboxylic acid component, saturated fatty acids with a straight-chain alkyl group, unsaturated fatty acids such as monoenoic acids and polyenoic acids, and hydroxy fatty acids may be exemplified. In addition, as unsaturated polycarboxylic acid, maleic acid, fumaric acid, citraconic acid, and itaconic acid may be exemplified. In addition, an anhydride of these compounds is also exemplified.

Reactive Polymer

A reactive polymer crosslinks the binder resin, and a reactive polymer with an oxazoline group may be exemplified. The toner of the exemplary embodiment is manufactured in an aqueous system, and thus the reactive polymer is preferably water-soluble. Specifically, commercially available products such as "EPOCROS WS-500" and "EPOCROS WS-700" manufactured by Nippon Shokubai Co., Ltd. may be exemplified.

As other reactive polymers, it is possible to use a compound with an epoxy group, and DENACOL EX313, 314, 421, 512, and 521 manufactured by Nagase Chemtex Corporation may be exemplified. These compounds with an epoxy group may be used alone when the toner binder resin is a resin with a carboxyl group (polyester-based or polystyrene-based resin with oxidation). Alternatively, it is also possible to add a substance with an amino group or a hydroxyl group.

By using these reactive polymers, it is possible to completely incorporate fine particles of coloring material in the toner, and an image density is improved, and image defects such as fogging reduced.

Charge Control Agent

By blending a charge control agent, it is possible to control the triboelectric charging charge amount of the toner. As the charge control agent, metal-containing azo compounds may be exemplified, and complexes in which the metal element is iron, cobalt, or chromium, complex salts or mixtures thereof are desirable. In addition, metal-containing salicylic acid derivatives also may be used, and complexes in which the metal element is zirconium, zinc, chromium, or boron, complex salts or mixtures thereof are desirable.

Coagulant

A coagulant which may be used is not particularly limited. In addition to monovalent metal salts such as sodium chloride, and polyvalent metal salts such as magnesium sulfate and aluminum sulfate, and non-metal salts such as ammonium chloride and ammonium sulfate, acids such as hydrochloric acid and nitric acid, and strong cationic coagulating agents such as polyamines and poly DADMACs may be appropriately used.

Surfactant

The surfactant is not particularly limited, and anionic surfactants such as sulfuric ester salts, sulfonates, phosphate esters, and fatty acid salts, cationic surfactants such as amine salts, and quaternary ammonium salts, amphoteric surfactants such as betaines, non-ionic surfactants such as polyethylene glycols, alkylphenol ethylene oxide adducts, and polyols, and polymeric surfactants such as polycarboxylic acid may be appropriately used. In general, the surfactant is added for the purpose of imparting dispersion stability such as stability of the agglomerated particles, and the surfactant may be used as a coagulant such as a surfactant with the opposite polarity.

pH Adjusting Agent

In order to control the pH in the system, a pH adjusting agent may be blended. The pH adjusting agent is not particular limited, and for example, basic compounds such as sodium hydroxide, potassium hydroxide, and amine compounds may be appropriately used as alkali, and acidic compounds such as hydrochloric acid, nitric acid, and sulfuric acid may be appropriately used as acid.

External Additive

In order to adjust the fluidity and the electrostatic property of the toner particles, inorganic fine particles of 0.01% by weight to 20% by weight with respect to the toner particles may be externally added and mixed. As the inorganic fine particles, silica, titania, alumina, strontium titanate, and tin oxide may be used alone or in a mixture of two or more kinds thereof. From the viewpoint of improving environmental stability, inorganic fine particles which are surface-treated with a hydrophobic agent are preferably used. In addition to such inorganic oxides, by externally adding fine resin particles with a diameter of 1 μm or less, it is possible to improve cleaning properties.

Moreover, it is desirable that when manufacturing a decolorable toner, a fine particle material which is a toner component is manufactured by a chemical manufacturing method, and then, the diameter of the fine particle material is made to be a toner particle diameter by a coagulation method. When manufacturing a non-decolorable toner, the fine particle material is usually manufactured by a pulverization method, and the fine particle material is subjected to a kneading process. In general, the temperature when kneading is higher than the decoloring temperature of the decolorable toner, and when components of the decolorable toner are kneaded, decoloring occurs. In order to avoid this, when manufacturing a decolorable toner, the chemical manufacturing method is employed instead of the mechanical pulverization method.

In the chemical manufacturing method, the toner particles are agglomerated, and a fusion process is performed to increase the toner circularity by smoothing the toner surface. In general, fusion is performed at a temperature of the glass transition temperature $T_g$ of the resin or higher. When the decoloring temperature of the coloring material is lower than the fusion temperature, decoloring occurs in the fusion process. If the fusion of the toner particles is performed at a temperature lower than the decoloring temperature of the coloring material, it is possible to avoid decoloring when fusing.

The non-decolorable toner used as a recording (printing) material without the decoloring function is not particularly limited, and a toner including non-decolorable toner particles in the related art including a colorant, a binder resin, and the like, and if necessary, an additive added to a toner particle surface may be used. Moreover, in a two-component developer, the toner and a carrier are mixed.

As the colorant, carbon black, or organic or inorganic pigments or dyes are used. Examples of the carbon black, which are not particularly limited, include acetylene black, furnace black, thermal black, channel black, and ketjen black.

Examples of the preferable yellow pigment include C.I. Pigment Yellow 1, 2, 3, 4, 5, 6, 7, 10, 11, 12, 13, 14, 15, 16, 17, 23, 65, 73, 74, 61, 83, 93, 95, 97, 98, 109, 117, 120, 137, 138, 139, 147, 151, 154, 167, 173, 180, 181, 183, and 185, and C.I. Vat Yellow 1, 3, and 20. These may be used alone or in a mixture thereof.

Examples of the preferable magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C.I. Pigment Violet 19, and C.I. Vat Red 1, 2, 10, 13, 15, 23, 29, and 35. These may be used alone or in a mixture thereof.

Examples of the preferable cyan pigment include C.I. Pigment Blue 2, 3, 15, 16, and 17, C.I. Vat Blue 6, and C.I. Acid Blue 45. These may be used alone or in a mixture thereof.

For example, as the binder resin, polyester-based resins and styrene-acryl-based resins may be used, and a wax may be added to the toner particles as a fixation assistant agent. In addition, the charge control agent (CCA) may be added. Among such non-decolorable toners, considering the fixing temperature and the decoloring temperature of the decolorable toner accommodated in the developing device 14*a*, a non-decolorable toner with a fixing temperature at about the same level as that of the decolorable toner is preferably used.

The non-decolorable toner may be manufactured by the mechanical pulverization method in the related art, and the chemical manufacturing method may also be employed.

Hereinafter, specific examples of the toner set are shown.

Non-decolorable Toner U

First, a non-decolorable toner is manufactured using the following components.

90 parts by weight of a polyester resin, 5 parts by weight of carbon black, 4 parts by weight of an ester wax, and 1 part by weight of a charge control agent were mixed. The obtained mixture was treated with a twin screw kneader in which the temperature was set at 120° C. to obtain a kneaded product, and the kneaded product was repeatedly pulverized and classified by an airflow-type pulverizer until the volume average particle diameter became 6.0 μm to 7.0 μm.

A desired electrophotographic toner was manufactured by attaching 2 parts by weight of hydrophobic silica and 0.5 parts by weight of titanium oxide to the obtained pulverized and classified product. Here, the electrophotographic toner is a non-decolorable recording material. The volume average particle diameter of the electrophotographic toner was measured by a Coulter counter (manufactured by Beckman Coulter Inc.), and the result was 6.3 μm. The toner obtained here is used as a non-decolorable toner U.

For example, the offset characteristics of the non-decolorable toner may be controlled by the kind and ratio of the binder resin or the release agent. For example, by increasing the glass transition temperature $T_g$ of the binder resin, it is possible to increase both the cold offset occurrence temperature and the hot offset occurrence temperature. In addition, for example, by reducing the amount of the release agent, it is possible to lower the hot offset occurrence temperature.

The decolorable toner is manufactured by the following method. Prior to the manufacture of the decolorable toner, a coloring material, an amorphous polyester resin, and a release agent dispersion are manufactured.

Manufacture of Coloring Material 3-(2-ethoxy-4-diethylaminophenyl)-3-(1-ethyl-2-methylindol-3-yl)-4-azaphthalide as a leuco dye, 2,2-bis(4'-hydroxyphenyl)hexafluoro propane as a color developing agent, and diester obtained from suberic acid and 2-(4-benzyloxyphenyl)ethanol as a decoloring temperature control agent were prepared. In addition, a solution was prepared by mixing 20 parts of an aromatic polyvalent isocyanate prepolymer and 40 parts of ethyl acetate, as an encapsulating agent.

1 part of the leuco dye, 5.0 parts of the color developing agent, and 50 parts of the decoloring temperature control agent were homogeneously dissolved by heating, a solution of the encapsulating agent was emulsified and dispersed in 300 parts of 8% polyvinyl alcohol aqueous solution, and the resultant product was stirred for 1 hour at 90° C. Thereafter, 2.5 parts of water-soluble aliphatic modified amine as a reactant was added thereto, the mixture was stirred for 6 hours, and encapsulated coloring material particles were manufactured.

The color of the obtained encapsulated coloring material particles was blue, and it was confirmed that the volume median particle diameter was 3 μm by a Multisizer 3 (manufactured by Beckman Coulter Inc.). In the encapsulated coloring material, a decoloring starting temperature was 90.5° C., and an effective solid content concentration was 70%.

Manufacture of Amorphous Polyester Resin

The following components were accommodated in a vessel, the temperature was raised to 210° C. in a nitrogen atmosphere, and the components were reacted at 210° C.

Polyoxypropylene(2.2)-2,2-bis(4-hydroxyphenyl)propane 53.1 parts by weight

Polyoxyethylene(2.0)-2,2-bis(4-hydroxyphenyl)propane 21.1 parts by weight

Fumaric acid 22.6 parts by weight

Adipic acid 3.2 parts by weight tert-Butyl catechol 0.1 parts by weight

Tin octylate 0.5 parts by weight

Thereafter, a condensation reaction was performed until reaching the desired softening point at 8.3 KPa in reduced pressure, thereby obtaining an amorphous polyester resin.

Manufacture of Release Agent Dispersion 480 g of deionized water and 4.3 g of dipotassium alkenylsuccinate aqueous solution (product name: LATEMUL ASK, manufactured by Kao Corporation, effective concentration 28% by weight) were accommodated in a beaker of 1 liter volume, and 120 g of carnauba wax was dispersed into the solution. While maintaining the temperature of the dispersion at 90° C. to 95° C., the dispersion was ultrasonically treated for 30 minutes by an ultrasonic homogenizer US-600T (product name, manufactured by NISSEI Corporation) to disperse the wax.

After cooling, deionized water was added to adjust the solid content to 20% by weight, and a release agent dispersion was obtained. The volume median particle diameter of the obtained release agent dispersion was 0.42 μm. The effective solid content concentration in the release agent dispersion was 40%.

Manufacture of Resin Dispersion

The above-described amorphous polyester resin, an anionic surfactant, a non-ionic surfactant, and potassium hydroxide aqueous solution of 5% by weight were accommodated in a stainless steel kettle of 5 liter volume by the following amount, respectively. The accommodated material was dispersed at 25° C. while being stirred at a speed of 200 r/min, and the temperature of the accommodated material was raised to 90° C.

Amorphous polyester resin 600 g

Anionic surfactant 40 g

Non-ionic surfactant 6 g

Potassium hydroxide aqueous solution of 5% by weight 218 g

As the anionic surfactant, "NEOPELEX G-15 (manufactured by Kao Corporation)" sodium dodecylbenzenesulfonate (solid content: 15% by weight) was used, and as the non-ionic surfactant, "EMULGEN 430 (manufactured by Kao Corporation)" polyoxyethylene (26 mol) oleyl ether was used.

After stabilizing the content at 90° C., the content was stirred for 2 hours. Subsequently, 1076 g of deionized water was added dropwise at 6 g/min to the content, and emulsion was obtained. The emulsion was cooled, and passed through a wire gauze to obtain a toner binder resin dispersion. The volume median particle diameter of resin fine particles in the obtained toner binder resin dispersion was 0.16 μm, and the solid content concentration was 32% by weight.

Decoloring Toner: Decolorable Toner E 290 g of deionized water was added to 28 g of the coloring material obtained above to sufficiently disperse the coloring material in water. 45 g of the release agent dispersion described above was added to the resultant product, and 200 g of a resin dispersion and 200 g of deionized water were further added, and quantitative feed was performed over 7 hours. The temperature was 45° C. When performing the quantitative feed, 100 g of ammonium sulfate aqueous solution (concentration 30%) was added as a coagulant.

Thereafter, 2.5 g of a crosslinking agent (EPOCROS WS-700, manufactured by Nippon Shokubai Co., Ltd.), 2.7 g of a dispersant (EMAL E-27C, manufactured by Kao Corporation), and 80 g of deionized water were added, the temperature of the mixture was raised to 65° C. and was left alone for 2 hours to fuse a toner. The volume median particle diameter was 10.5 μm. Furthermore, the toner was washed with pure water, and dried until a water concentration became 1% by mass or less.

Finally, 3.0 parts by mass of NAX 50 ($SiO_2$) and 0.3 parts by mass of NKT 90 ($TiO_2$) manufactured by NIPPON AEROSIL CO., LTD. with respect to 100 parts by mass of the toner were externally added to obtain a decolorable toner. The obtained toner is used as the decolorable toner E.

Using the image forming apparatus shown in FIG. 1, the cold offset occurrence temperature and the hot offset occurrence temperature were determined as follows with respect to the non-decolorable toner U and the decolorable toner E obtained above.

The cold offset occurrence temperature was determined by measuring a lower limit temperature of fixing where cold offset does not occur. Specifically, while maintaining the fixing portion of the image forming apparatus at a predetermined temperature, printing was performed on a white sheet. The temperature of the fixing portion, for example, was changed in a range of 70° C. to 90° C.

While changing the temperature of the fixing portion, the color difference ΔE at the location on the printed sheet, which should have nothing printed thereon, were measured by a reflection spectroscopic densitometer (x-rite 939, manufactured by X-Rite Inc.) ΔE means color density difference between the measured portion and blank sheet. If ΔE is 0.4 or greater, it is determined that the cold offset occurs, and the temperature at this time is set as the cold offset occurrence temperature (fixing lower limit temperature).

The hot offset occurrence temperature was determined by measuring a fixing upper limit temperature. The temperature of the fixing portion at this time may be changed in a range of 95° C. to 125° C. For the non-decolorable toner, the hot offset was determined by the same measurement method as that in the cold offset. For the decolorable toner, after a print sample was cooled and recolored, ΔE was measured in the same manner as that described above, and if ΔE is 0.4 or greater, it is determined that hot offset occurs. The temperature at this time was set as the hot offset occurrence temperature (fixing upper limit temperature).

For the non-decolorable toner, the temperature range from a temperature at which the cold offset occurs to a temperature at which the hot offset occurs is set as the non-offsetting range.

For the decolorable toner, the temperature range from a temperature at which cold offset occurs to a temperature at which hot offset occurs when fixing is set as the fixing non-offsetting range. The erasing non-offsetting range of the decolorable toner is a temperature range from the upper limit temperature at which erasure of an image is completed to a temperature at which hot offset occurs.

The image forming erasing system includes the image forming apparatus shown in FIG. 1 and the erasing apparatus shown in FIG. 2. In the image forming erasing system, forming and erasing of the image are performed using a predetermined toner set, and the offset is examined when erasing an erasable image and fixing a toner image.

EXAMPLE 1

A toner set of the exemplary embodiment includes a decolorable toner E and a non-decolorable toner U. A non-offsetting range of the non-decolorable toner U was 70° C. to 140° C., and a fixation non-offsetting range of the decolorable toner E was 70° C. to 125° C.

Using the toner set comprising the decolorable toner E and the non-decolorable toner U, after the fixing temperature of the fixing portion was set to 80° C., an erasable image and a unerasable image were formed on a sheet. Next, the erasable image was erased by heating the sheet. The density of the erasable image formed using the decolorable toner E began to be reduced when exposed to 90° C., and the image was completely erased at 95° C. A decoloring temperature of a decoloring portion is 95° C. The temperature $T_e$ in the example is 90.5° C. Each temperature range of the decoloring toner E is shown in the following Table 1.

TABLE 1

| | Temperature range |
|---|---|
| Fixing non-offset | 70° C. to 125° C. |
| Fixable (under coloring) | 70° C. to 90° C. |
| Decoloring non-offset | 95° C. to 125° C. |
| Decolorable | 95° C. to 125° C. |

In the toner set of the example, a hot offset occurrence temperature $T1_U$ of the decolorable toner was 125° C., and a hot offset occurrence temperature $T2_U$ of the non-decolorable toner was 140° C. Both temperatures were higher than the decoloring temperature of 95° C., and thus when erasing the erasable image, hot offset did not occur.

In the toner set of the example, the hot offset occurrence temperature of the decolorable toner and the hot offset occurrence temperature of the non-decolorable toner were 125° C. and 140° C., respectively, and both temperatures were 20° C. or more higher than the decoloring temperature of 95° C. In addition, the non-offsetting range of the decolorable toner when decoloring and the non-offsetting range of the non-decolorable toner were overlapped at 95° C. to 125° C. Since the temperature range (decoloring margin temperature width) that may erase an image without the offset was 30° C., problems such as abnormal fixing which causes an image density of the fixed image to be uneven, also did not occur when erasing the image.

Furthermore, in the toner set of the example, both a cold offset occurrence temperature $T1_L$ of the decolorable toner and a cold offset occurrence temperature $T2_L$ of the non-decolorable toner was 70° C., and this temperatures was lower than the fixing temperature of 80° C. Therefore, when fixing the toner image, cold offset also did not occur.

In the toner set of the example, both the cold offset occurrence temperature of the decolorable toner and the cold offset occurrence temperature of the non-decolorable toner was 70° C. and this temperature was 20° C. or more lower than the decoloring temperature of 95° C. In addition, the non-offsetting range when fixing the decolorable toner and the non-offsetting range of the non-decolorable toner overlapped in a temperature range of at 70° C. to 90° C. The temperature range (fixing margin temperature width) in which the toner image may be fixed without offset, without decoloring the decolorable toner, was 20° C. Thus, even when fixing the toner image, problems such as abnormal fixing, which causes the image density of the fixed image to be uneven, did not occur.

EXAMPLE 2

A toner set of the example includes the non-decolorable toner of which the non-offset range was 80° C. to 150° C. instead of the non-decolorable toner U of Example 1.

In the toner set of the example, the hot offset occurrence temperature $T1_U$ of the decolorable toner was 125° C., and the hot offset occurrence temperature $T2_U$ of the non-decolorable toner was 150° C. Both temperatures were higher than the decoloring temperature of 95° C., and thus when erasing the erasable image, hot offset did not occur.

In the toner set of the example, the hot offset occurrence temperature of the decolorable toner and the hot offset occurrence temperature of the non-decolorable toner were 125° C. and 140° C., respectively, and both temperatures were 20° C. or more higher than the decoloring temperature of 95° C. In addition, the non-offsetting range when decoloring the decolorable toner and the non-offsetting range of the non-decoloring toner were overlapped at 95° C. to 125° C. Since the temperature range (decoloring margin temperature width) that may erase an image without the offset was 30° C., problems such as abnormal fixing, which causes the image density of the fixed image to be uneven, also did not occur when erasing the image.

COMPARATIVE EXAMPLE

A toner set of the comparative example includes the non-decolorable toner of which the non-offsetting range is 70° C.

to 110° C. instead of the non-decolorable toner U in Example 1. The decoloring temperature of the decoloring portion was set at 110° C.

In the toner set of the comparative example, both the cold offset occurrence temperature $T1_L$ of the decoloring toner and the cold offset occurrence temperature $T2_L$ of the non-decoloring toner were 70° C., and that temperature is lower than the fixing temperature of 80° C. Therefore, when fixing the toner image, cold offset did not occur. In addition, in the toner set of the comparative example, since a fixing margin temperature width was 20° C., when fixing the toner image, problems such as abnormal fixing, which causes the image density of the fixed image uneven, did not occur.

However, when erasing the erasable image, the hot offset phenomenon of the non-decolorable toner was observed. In the toner set of the comparative example, the non-offsetting range of the decolorable toner when decoloring and the non-offsetting range of the non-decolorable toner were overlapped at 95° C. to 110° C., and the decoloring margin temperature width was only 15° C. Due to this, problems such as abnormal fixing, which causes the image density of the fixed image to be uneven, occurred when forming an image.

According to the exemplary embodiment, using the decolorable toner and the non-decolorable toner, it is possible to perform formation of an image by using the decolorable toner and the non-decolorable toner, and erasure of an image formed with the decolorable toner, in one image forming and erasing system, and it is possible to simplify the apparatus used for fixing and/or erasing of the toner image. In particular, when forming an image using the decolorable toner and the non-decolorable toner, it is possible to perform fixing of both under the same temperature conditions.

In the above embodiment, 'decoloring' means to make it difficult to recognize a color of an image formed on an image receiving member after the image is formed on the image receiving member by a recording material which has different color from the color of the image receiving material. The color of recording material may be achromatic color including black or white, and not limited to chromatic color. Also, in the following embodiment, 'decoloring the image' means 'erasing the image'.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner set which is used in a printing system that is capable of recycling a medium and includes an image forming apparatus which has a first image forming portion which forms a toner image on the medium with a decolorable toner which is decolored by being heated at a temperature $T_e$ (° C.) or higher, a second image forming portion which forms a toner image on the medium with a non-decolorable toner and forms an image on the medium with at least one of the toners, and a decoloring apparatus provided with a heating portion which heats the medium on which a toner image is formed by the image forming apparatus to a temperature $T_e$ or higher, wherein, when being heated by the decoloring apparatus the decolorable toner is decolored, without causing a hot offset, in a temperature range in which a temperature of the heating portion is the temperature $T_e$ or higher and a temperature $T1_U$ or lower, and wherein, when heating the medium on which an image is formed with the non-decolorable toner by the decoloring apparatus, the non-decolorable toner does not cause the hot offset at a temperature $T2_U$ or lower, a difference between the temperature $T_e$ and the temperature $T1_U$ is 20° C. or more, and $T1_U<T2_U$.

2. The toner set according to claim 1, wherein in the decolorable toner, cold offset does not occur at a temperature of $T1_L$ ($T1_L<T1_U$) or higher, in the non-decolorable toner, cold offset does not occur at a temperature $T2_L$ ($T2_L<T2_U$) (° C.) or higher, and both temperatures $T1_L$ and $T2_L$ are 20° C. or more lower than the temperature $T_e$.

3. The toner set according to claim 1, wherein the decolorable toner is manufactured using a chemical manufacturing process.

4. The toner set according to claim 3, wherein the non-decolorable toner is manufactured using pulverization, and the decolorable toner is not manufactured using a pulverizing step.

5. A printing system that is capable of recycling a medium and includes an image forming apparatus which has a first image forming portion which forms a toner image on the medium with a decolorable toner which is decolored by being heated at a temperature $T_e$ or higher and a second image forming portion which forms a toner image on the medium with a non-decolorable toner, and forms an image on the medium with at least one of the toners, and a decolorable apparatus provided with a heating portion which heats the medium on which a toner image is formed by the image forming apparatus at the temperature $T_e$ or higher, wherein, when being heated by the decolorable apparatus, the decolorable toner is decolored without causing a hot offset in a temperature range in which a temperature of the heating portion is the temperature $T_e$ or higher and a temperature $T1_U$ or lower, and wherein, when heating the medium on which an image is formed with the non-decolorable toner by the decolorable apparatus, the non-decolorable toner does not cause the hot offset at a temperature $T2_U$ or lower, a difference between the temperature $T_e$ and the temperature $T1_u$ is 20° C. or more, and $T1_U$ (° C.)<$T2_U$ (° C.).

6. The system according to claim 5, wherein the difference between the temperature $T_e$ and the temperature $T1_U$ is 20° C. or more.

7. The system according to claim 5, wherein in the decolorable toner constituting the toner set, a cold offset does not occur at a temperature $T1_L$ ($T1_L<T2_U$) or higher, in the non-decolorable toner constituting the toner set, the cold offset does not occur at a temperature $T2_L$ ($T2_L<T2_U$) or higher, and both the temperatures $T1_L$ and $T2_L$ are 20° C. or more lower than the temperature $T_e$.

8. The system according to claim 5, wherein the decolorable toner constituting the toner set contains a decoloring coloring material including an electron donating coloring agent, an electron receptive color developing agent, a decoloring temperature control agent, and a binder resin.

9. The system according to claim 8, wherein in the decoloring coloring material included in the decolorable toner constituting the toner set is microencapsulated.

10. The system according to claim 5, wherein a decolorable and a non decolorable toner are printed on the same sheet.

11. The system according to claim 5, further comprising a transfer path comprising:

a first path by which the presence of an image on a sheet may be detected;

a second path at which an image on a sheet may be exposed to a decoloring temperature of a decolorable toner; and wherein the first and second paths are interconnected to enable:

imaging the surface of a sheet in the first path to detect the presence of an image thereon;

transferring of a sheet having an image thereon to the heating portion of the decoloring apparatus on the second feed path; and again imaging the surface of a sheet in the first path to detect the presence of an image thereon.

12. The system according to claim 11, further comprising:

a first and a second sheet tray;

a tray feed path bifurcated between a recyclable sheet tray path and a non recyclable sheet tray path.

13. The system according to claim 12, wherein the decolorable apparatus is configured to feed a sheet imaged on the first path and determined to not have an image thereon to the recyclable sheet tray path.

14. The system according to claim 12, wherein the decolorable apparatus is configured to feed a sheet imaged on the first path after passing through a decoloring system in the second path and determined to have an image thereon to the non recyclable tray path.

15. The system according to claim 5, wherein the decolorable toner is manufactured using a chemical manufacturing process.

16. The system according to claim 15, wherein the non-decolorable toner is manufactured using pulverization, and the decolorable toner is not manufactured using a pulverizing step.

17. An image forming apparatus that includes a first image forming portion which forms a toner image on a medium with a decolorable toner which is decolored by being heated at a temperature $T_e$ (° C.) or higher, and a second image forming portion which forms a toner image on the medium with a non-decolorable toner and forms an image on the medium with at least one of the toners, wherein the decolorable toner is decolored, without causing hot offset, in a temperature range of the temperature $T_e$ or higher and a temperature $T1_U$ of lower, and wherein the non-decolorable toner does not cause a hot offset at a temperature $T2_U$ or lower, a difference between the temperature $T_e$ and the temperature $T2_U$ is 20° C. or more, and $T1_U \geq T2_U$.

18. The apparatus according to claim 17, wherein in the decolorable toner of the toner set, cold offset does not occur at a temperature $T1_L$ ($T1_L < T1_U$) or higher, in the non-decolorable toner of the toner set, cold offset does not occur at a temperature $T2_L$ ($T2_L < T2_U$) or higher, and both the temperatures $T1_L$ and $T2_L$ are 20° C. or more lower than the temperature $T_e$.

19. The apparatus according to claim 17, wherein the decolorable toner of the toner set contains a decolorable coloring material including an electron donating coloring agent, an electron receptive color developing agent and a decoloring temperature control agent, and a binder resin.

20. The apparatus according to claim 19, wherein the decolorable coloring material included in the decolorable toner of the toner set in micro-encapsulated.

* * * * *